US005802140A

United States Patent [19]

Virshup et al.

[11] Patent Number: 5,802,140

[45] Date of Patent: Sep. 1, 1998

[54] X-RAY GENERATING APPARATUS WITH INTEGRAL HOUSING

[75] Inventors: Gary F. Virshup, Cupertino, Calif.; Christopher F. Artig, Summit Park; John E. Richardson, Salt Lake City, both of Utah

[73] Assignee: Varian Associates, Inc., Palo Alto, Calif.

[21] Appl. No.: 920,747

[22] Filed: Aug. 29, 1997

[51] Int. Cl.[6] ..... H01J 35/06

[52] U.S. Cl. ..... 378/136; 378/121

[58] Field of Search ..... 378/136, 121, 378/125, 127, 137, 138, 139, 141, 142, 203

[56] References Cited

U.S. PATENT DOCUMENTS 4,811,375 3/1989 Klostermann ..... 378/141 X 4,841,557 6/1989 Haberrecker et al. ..... 378/141

5,056,126 10/1991 Klostermann et al. ..... 378/127

5,515,413 5/1996 Knudsen et al. ..... 378/136

5,703,924 12/1997 Hell et al. ..... 378/136

*Primary Examiner*—David P. Porta

*Attorney, Agent, or Firm*—Bella Fishman

[57] ABSTRACT

An X-ray generating apparatus is provided with a unitary vacuum enclosure having a rotating anode target and a cathode assembly for generating X-rays transmitted through an X-ray window. The cathode assembly is placed within the vacuum enclosure through an opening in the top wall thereof, and comprises a disk which completely covers this opening. The unitary vacuum enclosure and the disk form a radiation shield. For increasing a thermal capacity of the unitary vacuum enclosure and installing the X-ray generating apparatus into a gantry it further comprises a mounting block which may be coupled to or encompass the unitary vacuum enclosure. The X-ray window is placed within the mounting block. A window adaptor may be utilized for the X-ray window installation.

20 Claims, 4 Drawing Sheets

X-RAY GENERATING APPARATUS WITH INTEGRAL HOUSING

FIELD OF THE INVENTION

The present invention relates to X-ray generating apparatus, and in particular to X-ray tubes with an improved unitary vacuum housing design which allows for a radiation protection and direct heat transmission through a body of the unitary vacuum housing.

BACKGROUND OF THE INVENTION

The X-ray generating apparatus generally comprises a vacuum enclosure with an anode assembly and a cathode assembly spaced therebetween. The cathode assembly comprises an electron emitting cathode which is disposed so as to direct a beam of electrons onto a focal spot of an anode target of the anode assembly. In operation, electrons emitting by the cathode are accelerated towards the anode target by a high voltage created between the cathode and the anode target. The accelerated electrons impinge on the focal spot area of the anode target with sufficient kinetic energy to generate a beam of X-rays which passes through a window in the vacuum enclosure.

However, only about one percent of the input energy is converted into X-radiation. The vast majority of the input energy is converted into thermal energy which is stored in the mass of the anode assembly. It is known in the art that by rotating the anode the heat generated during X-ray production can be spread over a larger anode target area. To improve the heat transfer by radiation the anode assembly is coated in a special way and is cooled by forced convection with, for example, a dielectric liquid as disclosed in the U.S. Pat. No. 4,928,296. The excessive thermal energy from the anode assembly is dissipated by thermal radiation to the surrounding enclosure.

In conventionally designed X-ray generating apparatus the vacuum enclosure is placed in a housing which serves as a container for cooling medium, typically cooling fluid or the forced air. In fluid cooled X-ray apparatus, the type disclosed for example in the U.S. Pat. No. 4,841,557, the rotating anode X-ray tube is immersed into the housing filled with an insulating fluid such as a transformer oil which is circulated by a pump for at least partially dissipating the heat from the vacuum enclosure.

The air cooled X-ray tube disclosed in the U.S. Pat. No. 5,056,126 comprises a housing with disposed therein an evacuated envelope having a cathode and an anode that are capable of being biased to a voltage in a range between about 1 kV and 200 kV, and a heat cage formed of a heat conducting material. The heat cage is provided within the interior of the vacuum enclosure surrounding an anode target. The heat cage absorbs heat from the anode and transports it to the end portion of the vacuum enclosure, and then to the exterior of the housing for dissipation by the air flow. The excessive radiation from the X-ray tube is blocked from exiting the housing by a lead liner which is provided between the evacuated envelop and the housing. The lead liner serves also as a massive heat sink for the X-ray tube.

Being advantageous in some respects the air cooled tube design has certain drawbacks. The presence of the heat cage inside the evacuated envelope elongates the heat path leading to a heat dissipation which results in excessive temperature built up over the exterior of the vacuum enclosure which may damage the lead liner.

Therefore it is an object of the present invention to provide a compact X-ray generating apparatus with reduced member of components resulting increased reliability and reduced manufacturing costs.

It is another object of the present invention to provide the X-ray generating apparatus having a multi-functional vacuum enclosure which serves as a radiation shield, as a heat reservoir for balancing the temperature within the vacuum enclosure in case of power loss and as a direct heat transfer element between an anode assembly and an air cooling system.

It is yet another object of the present invention to provide the air cooling X-ray generating apparatus comprising a multi-functional mounting block which serves as an installation element, as a heat reservoir and as an element of a cooling system.

SUMMARY OF THE INVENTION

In accordance with the present invention, there is provided an X-ray generating apparatus which comprises a unitary vacuum enclosure formed by a cylindrically shaped body having side, top and bottom walls with respective openings therein. The top and side walls are made of materials capable to provide a required radiation shielding which does not exceed the FDA requirement of radiation transmission equals to 100 mRad/hr at 1 meter from the X-ray generating apparatus with 150 kV at rated power. The unitary vacuum enclosure has an anode assembly with a rotating anode target and a cathode assembly spaced therebetween. The unitary vacuum enclosure has a thermal capacity that is substantially larger than a thermal capacity of the anode target. The cathode assembly has an electron source for emitting electrons that strikes the rotating anode target to generate X-rays which are released through an X-ray window coupled to the opening in the side wall of the unitary vacuum enclosure, the cathode assembly comprises further a mounting structure for holding said electron source, and a disk made of a high Z-material and attached to the mounting structure and facing the anode target for shielding the opening in the top wall of the unitary vacuum enclosure against the X-rays.

According to one aspect of the present invention, a mounting block is attached to the side wall of the unitary vacuum enclosure. The mounting block has a port which is coupled to the opening in the side wall, and a window adapter which is disposed within the mounting block for holding the X-ray window in a remote distance from the side wall opening. The window adapter has a cylindrical body with a bore therein for transmitting the X-rays therethrough, wherein an interior of the window adapter is an extended part of the unitary vacuum enclosure.

The X-ray generating apparatus is cooled by an air flow which is produced by a fan. A plurality of fins may be disposed over an outer periphery of the cylindrical side wall of the unitary vacuum enclosure for transferring heat directly from the walls of the vacuum enclosure to the fins. A protective cover is installed over the fan and fins.

The air cooling may be provided by utilizing a special configuration of the mounting block. According to yet another aspect of the present invention, the mounting block houses the unitary vacuum enclosure and has a body with a plurality of channels therein for cooling the unitary vacuum enclosure by air flow passing through these channels.

These and other objectives and advantages of the present invention will become clear from the detailed description given below in which preferred embodiments are described in relation to the drawings. The detailed descriptions presented to illustrate the present invention, but is not intended to limit it.

BRIEF DESCRIPTION OF THE DRAWINGS

Embodiments of the present invention are shown by way of examples in the accompanying drawings, wherein.

DETAILED DESCRIPTION OF THE PREFERRED EMBODIMENT

Figure 1:
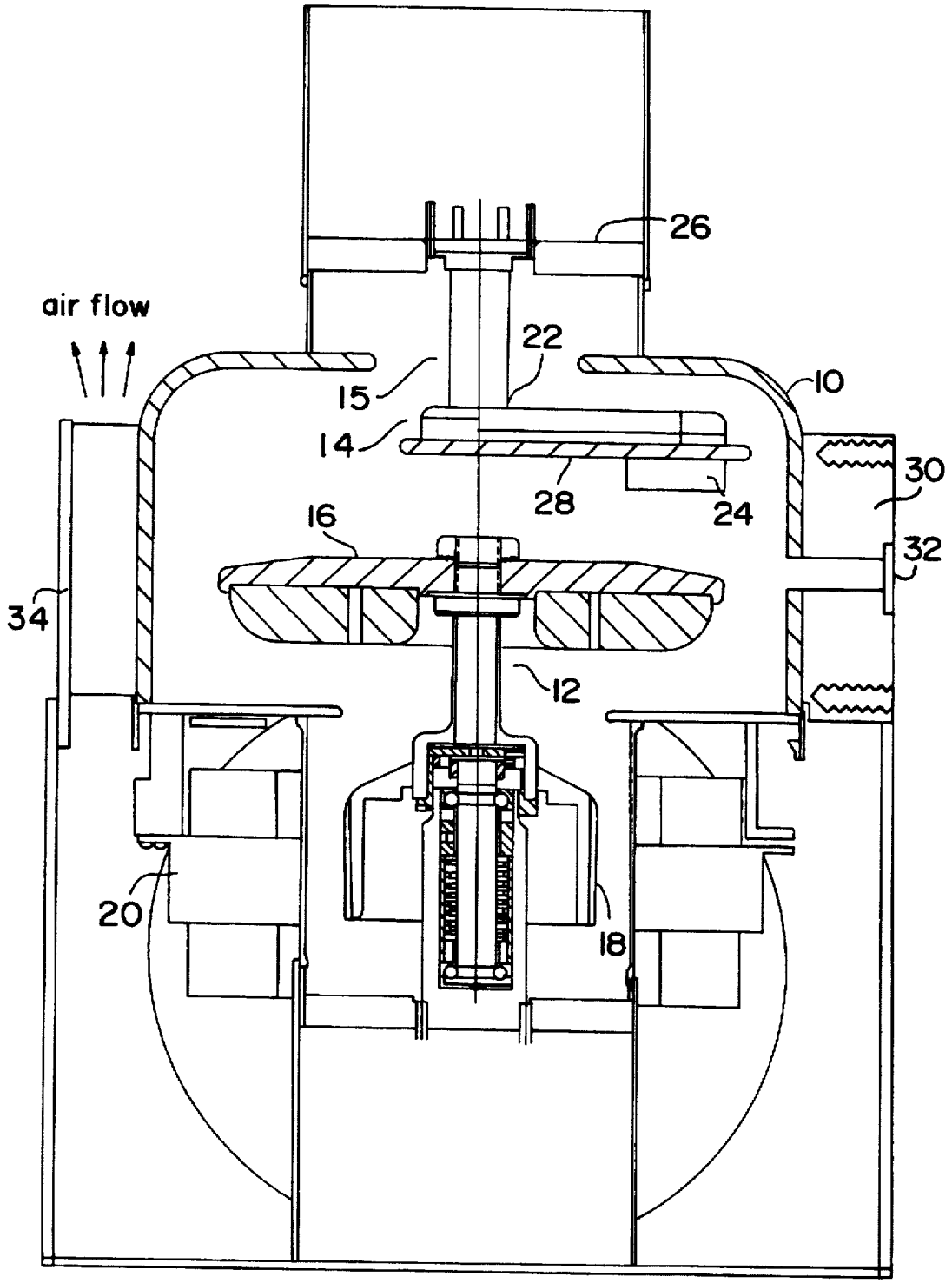
FIG. 1 is a cross-sectional view of an X-ray generating apparatus embodying an integral housing of the present invention.

An X-ray generating apparatus of the present invention is shown in FIG. 1 and comprises unitary vacuum enclosure 10 with disposed therein rotating anode assembly 12 and cathode assembly 14. Rotating anode assembly 12 comprises anode target 16 which is connected via a shaft to rotor 18 for rotation. Stator 20 is disposed outside unitary vacuum enclosure 10 proximate to rotor 18. Cathode assembly 14 comprises mounting structure 22 with electron source 24 mounted thereon. Cathode assembly 14 is placed within the vacuum enclosure through opening 15 in a top wall of unitary vacuum enclosure 10 and vacuum tight thereto by ceramic insulator 26. Cathode assembly 14 comprises also disk 28 which is attached to mounting structure 22 and having an aperture for protruding electron source 24 therethrough. The diameter of disk 28 is chosen so as to shield opening 15.

Figure 2:
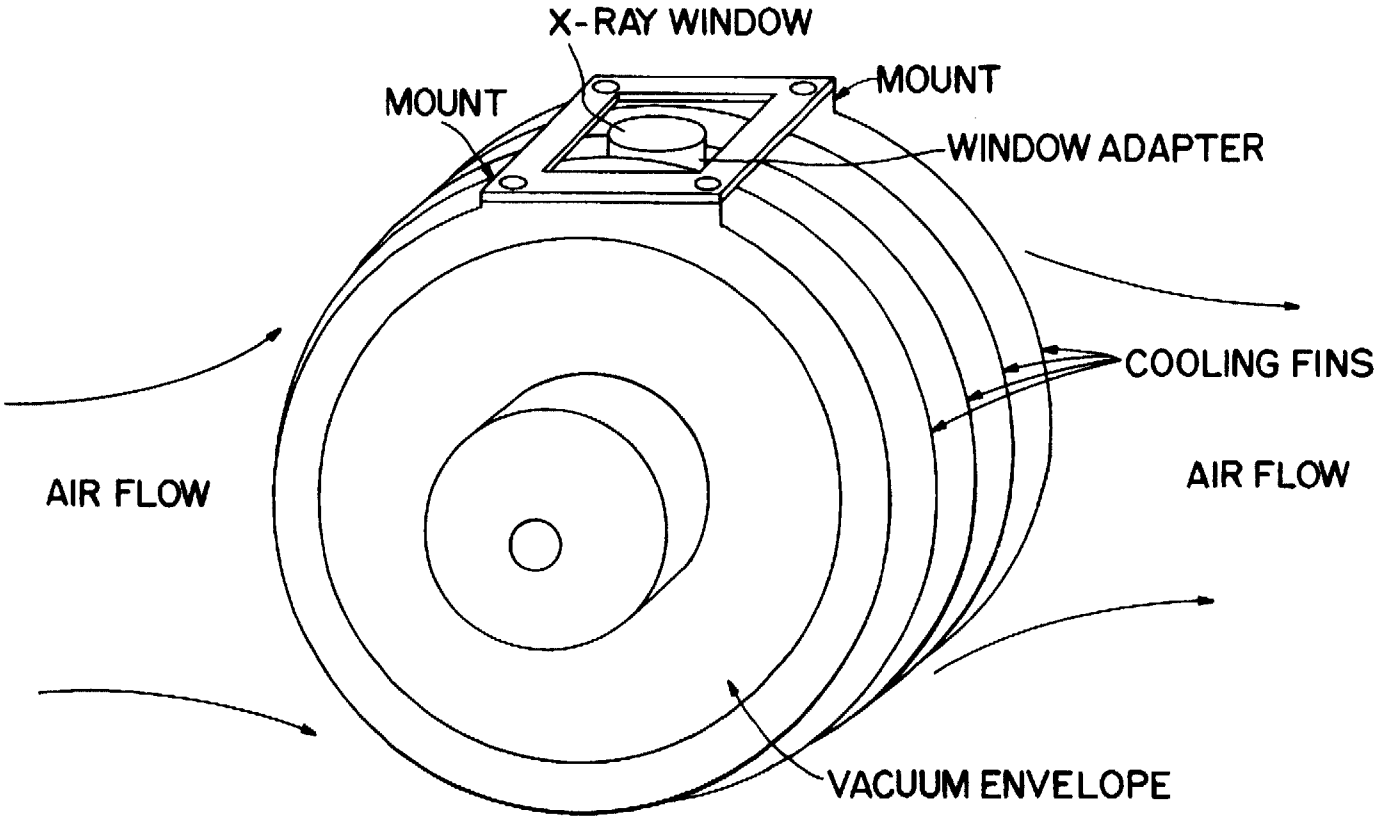
FIG. 2 is a prospective view of the X-ray generating apparatus of the present invention showing a position of a mounting block with a window adapter at a side wall of a unitary vacuum enclosure.

Mounting block 30 according to one embodiment is shown in FIG. 1 and FIG. 2. Mounting block 30 has a cylindrically shaped body with a port therein, and it is mechanically attached to unitary vacuum enclosure 10 so as the port is coupled to an X-ray opening in the side wall of the unitary vacuum enclosure. Mounting block 30 may be either brazed or bolted to the vacuum enclosure.

Figure 3A:
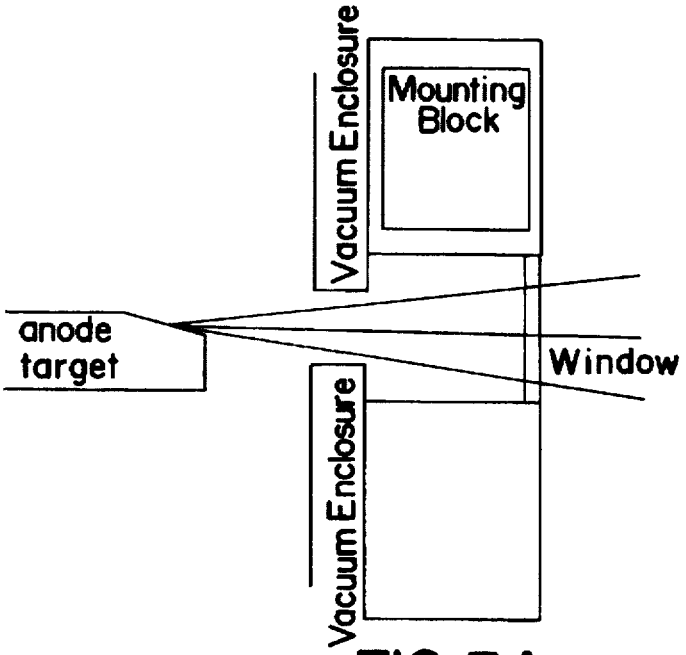
FIG. 3*a* is a schematic illustration of placement of an X-ray window within the mounting block.
Figure 3B:
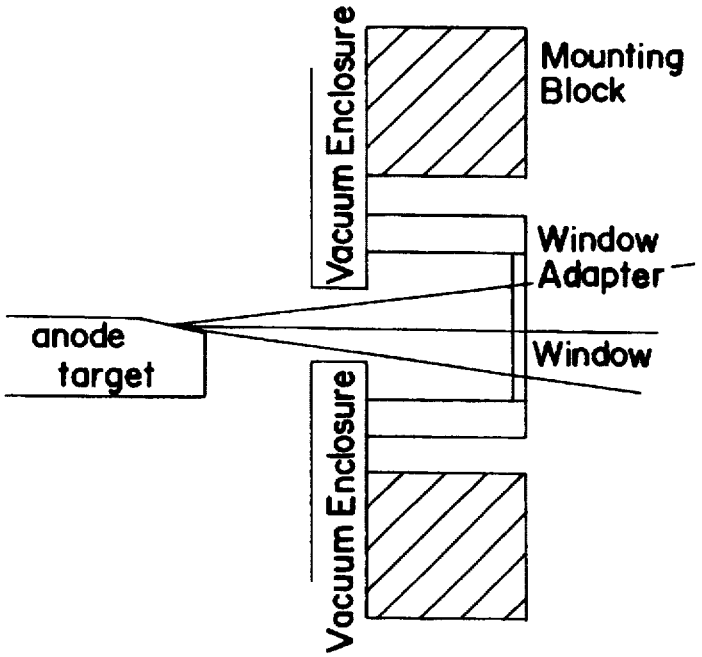
FIG. 3*b* is a schematic illustration of placement of the X-ray window on a window adaptor within the mounting block.

High voltage means (not shown) are proved for creating a potential between cathode assembly 14 and anode assembly 12 to cause an electron beam generated by electron source 24 to strike anode target 16 with sufficient energy to generate X-rays. The anode assembly is maintained at a positive voltage of about +75 kv while the cathode assembly is maintained at an equally negative voltage of about −75 KV. Window 32 permits transmission of X-rays. FIGS. 3*a* and 3*b* give a schematic illustration of different ways of installation of the X-ray windows. According to the embodiment of the present invention shown in FIG. 3*b*, X-ray window is attached to a window adapter. It has a cylindrical body with a bore for transmitting X-rays therethrough. The window adapter being sealed to the side wall forms an extended part of unitary vacuum enclosure 10.

The X-ray opening in the side wall of unitary vacuum enclosure 10 has a diameter which is substantially narrower than a diameter of the bore of the window adapter. Mounting block 30 may house the window adapter or X-ray window may be attached to the end of the port opposite to the X-ray opening as shown in FIG. 3*a*. The material of the window adapter must be thermally compatible with the material of vacuum enclosure 10 and material of window 32. The remote positioning of the window from the anode target allows to reduce the temperature of the window. It is especially important since in operation, the temperature within the vacuum enclosure is higher in the window area due to the contribution of "secondary" due to secondary electron bombardment from electrons back scattered from the focal spot on the anode target. Since the electrons are scattered at random angles only a small portion of them travel so as to heat the window in its new location. Tests performed with the remote position of the window demonstrated that during operation for the window of 0.55 inches in diameter its temperature has been increased by 15° C. during a 15 second, 24 kilowatts scan.

Mounting block 30 in addition to its traditional installation function is used for increasing the thermal capacity of the apparatus and along with fins 34 placed over the perimeter of unitary vacuum enclosure 10 for enhancing heat transfer from the anode assembly to the region outside the vacuum enclosure.

Figure 4:
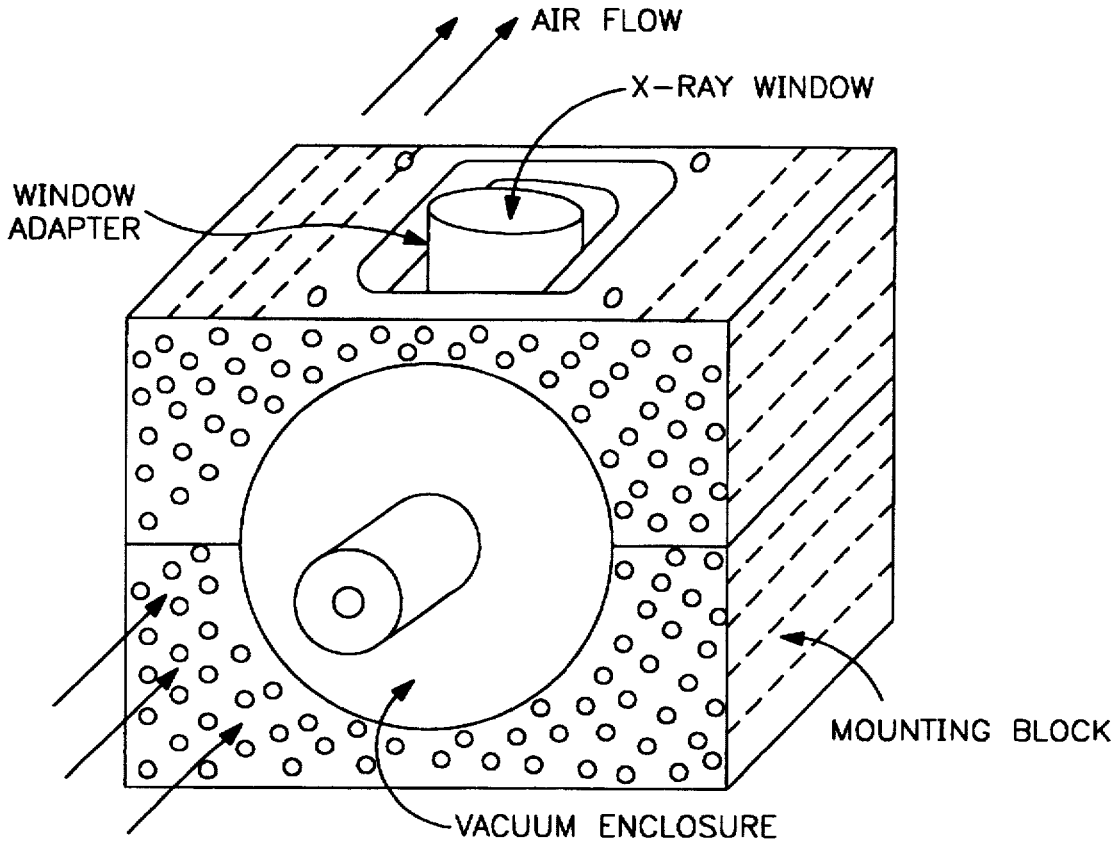
FIG. 4 is a prospective view of the X-ray generating apparatus showing the split mounting block housing the unitary vacuum enclosure.

According to one embodiment of the present invention the split mounting block can house the vacuum enclosure therein as shown in FIG. 4. A plurality of channels are made in a body of the mounting block to let air flow therethrough. In this embodiment it is not necessary to use fins since such structure of the mounting block provides adequate thermal storage.

The X-ray generating apparatus of the present invention utilizes air cooling technique when heat from the vacuum enclosure dissipates by convection due to air flow provided by the fan. Depending on the application of the X-ray apparatus the air may be forced to flow axially as shown in FIG. 1 or across the tube as shown in FIG. 4.

The unitary vacuum enclosure of the present invention functions as a radiation shield. The choice of material for the enclosure and its thickness is defined by its ability to lower the radiation transmission to one fifth of the FDA requirement which equals 20 mRad/hr at 1 meter distance from the X-ray generating apparatus with 150 KV potential maintained between anode and cathode assemblies at rated power of the beam. The material also may be chosen depending on desired cost of manufacturing the unitary vacuum enclosure. For example, Copper is the least expensive material, however, the thickness of the top and side walls of the vacuum enclosure should be about 1.35 inches to achieve the required radiation protection, while using Molybdenum which is much more expensive material allows for reducing the thickness of the walls to about 0.58 inches.

Thermal capacity, another very important parameter should be considered in the choice of material for vacuum enclosure as well, since thermal capacity defines the ability of the unitary vacuum enclosure functions as a thermal reservoir in case of power loss when heat accumulated by the anode assembly would suddenly be transferred to the walls of the vacuum enclosure. The thermal capacity of the anode assembly ($TM_{AS}$) is defined as follows:

$$TM_{As} = \frac{\Sigma}{i} M_{iA} C\rho_{iA} \tag{1}$$

where $M_{iA}$ is the mass of the elements of the anode assembly such as the anode target, the shaft with associated parts.

$C\rho_{iA}$ is specific heat of each element of the anode assembly.

The thermal capacity of the unitary vacuum enclosure is defined as follows:

$$TM_{VE} = \sum_i M_{iVE} C\rho_{iVE} \quad (2)$$

where $M_{iVE}$ is the mass of the elements of the unitary vacuum enclosure such as side, top and bottom walls, mounting block with associated parts.

$C\rho_{iVE}$ is a specific heat of each element of the unitary vacuum enclosure.

In operation, an estimate of the energy stored by the anode assembly with target temperature $T_{As}$ will be equal to $TM_{As} \cdot T_{As}$, while the energy stored by the unitary vacuum enclosure will be equal to $TM_{VE} \cdot T_{VE}$.

In the case of loss of power the anode assembly would start to cool and the vacuum enclosure correspondingly would start to heat up. This process will continue until the anode assembly and the unitary vacuum enclosure reach equilibrium at a temperature $T_{eq}$ which may be defined as follows:

$$TM_{As} \cdot (T_{As} - T_{eq}) = TM_{VE} \cdot (T_{eq} - T_{VE}) \quad (3)$$

equation (3) may be written as follows:

$$\frac{TM_{As}}{TM_{VE}} = \frac{T_{eq} - T_{VE}}{T_{As} - T_{eq}} \quad (4)$$

For $T_{As}$=1100° C., $T_{VE}$=100° C., and $T_{eq}$=200° C., the ratio of TM $_{As}$/TM+hd VE will be:

$$\frac{TM_{As}}{TM_{VE}} = \frac{(200-100)}{(1100-200)} = \frac{1}{9} \quad (5)$$

Accordingly, the thermal capacity of the unitary vacuum enclosure should at least exceed 9 times the thermal capacity of the anode assembly. The unitary vacuum enclosure made of, for example, Copper will have a thermal capacity which is thrice high than Molybdenum.

The present invention utilizing multi-functional unitary vacuum enclosures allows for manufacturing a compact X-ray generating apparatus with fewer components and resulting high reliability and lower costs. The walls of the unitary vacuum enclosure are used for direct transmission of heat therethrough, for radiation shielding and for heat accumulation due to power loss when the anode target is at full heat storage capacity.

The present invention has been described with reference to the preferred embodiments. Modifications and alterations will be obvious to others skilled in the art upon reading and understanding the preceding detailed description. It is intended that the invention be construed as including all such modifications and alterations if they come within the scope of the appended claims or the equivalents thereof.

What is claimed is:

1. An X-ray generating apparatus comprising:

a unitary vacuum enclosure formed by a cylindrical side wall and a top and bottom walls with respective openings therein, said top and side walls being made of materials capable to provide a required radiation shielding;

an anode assembly having a rotating anode target disposed within said unitary vacuum enclosure, said unitary vacuum enclosure having a thermal capacity that is substantially larger than a thermal capacity of said anode target;

a cathode assembly spaced from said anode assembly having an electron source for emitting electrons that strikes said rotating anode target to generate X-rays which are released through an X-rays window of said unitary vacuum enclosure, a mounting structure for holding said electron source, and a disk attached to said mounting structure and facing said anode target for shielding said opening in said top wall of said unitary vacuum enclosure against said X-rays, said disk being thermally coupled to said vacuum enclosure.

2. The X-ray generating apparatus of claim 1, wherein said disk of said cathode assembly has an aperture for protruding said electron source toward said anode target.

3. The X-ray generating apparatus of claim 2, wherein said disk is made of a high Z-material.

4. The X-ray generating apparatus of claim 3, further comprising a mounting block which is attached to said cylindrical side wall, said mounting block has a port which is coupled to said opening in said cylindrical side wall, and a window adapter which is disposed within said mounting block for holding said X-ray window in a remote distance from said opening in said side cylindrical wall, said window adapter has a cylindrical body with a bore therein for transmitting the X-rays therethrough, wherein an interior of said widow adapter is an extended part of said unitary vacuum enclosure.

5. The X-ray generating apparatus of claim 3, further comprising a mounting block which is attached to said side cylindrical side wall, said mounting block comprises a port terminated by said X-ray window, said port is coupled to said X-rays exit opening so as to maintain a vacuum integrity within said unitary vacuum enclosure.

6. The X-ray generating apparatus of claim 3, wherein said unitary vacuum enclosure, X-ray window and said mounting block have corresponding characteristics of thermal expansion.

7. The X-ray generating apparatus of claim 6, further comprising:

a plurality of fins disposed over an outer perimeter of said cylindrical side wall of said vacuum enclosure;

a motor for rotating said anode target;

a fan cooling device for producing flow of air through said plurality of fins for cooling of said walls of said unitary vacuum enclosure thereby directly transferring heat accumulated within said unitary enclosure directly to said plurality of fins; and a protective cover, said protective cover housing said plurality of fins, motor and fan therein.

8. The X-ray generating apparatus of claim 7, wherein a thermal capacity of said cathode assembly, mounting block, protective cover, motor and fan is about one order of magnitude higher than a thermal capacity of said anode target.

9. The X-ray generating apparatus of claim 7, wherein a thermal capacity of said vacuum enclosure is about one order of magnitude higher than a thermal capacity of said anode target.

10. The X-ray generating apparatus of claim 9, wherein said vacuum enclosure is made preferably of tungsten alloy, said disk is made preferably of molybdenum, and said window is made preferably of copper.

11. An X-ray generating apparatus comprising:

a rotatable anode assembly having an anode target;

a cathode assembly spaced from said anode assembly and having an electron source for emitting electrons that strikes said anode target to generate X-rays, and a disk for mounting said electron source therein;

a unitary vacuum enclosure having a cylindrically shaped body with respective openings in a top, bottom and side walls, a diameter of said disk being larger than a diameter of said top opening, wherein said unitary vacuum enclosure and said disk are made of a material capable of shielding the X-rays, and said top opening is protected by said disk; and a pair of feed through insulators, each placed through said respective top and bottom walls to for applying a negative electrical potential to said electron source and a positive electrical potential to said anode target.

12. The X-ray generating apparatus of claim 11, further comprising a mounting block, said mounting block is disposed outside of said unitary vacuum enclosure and comprises a port with an end window, said port is coupled to said opening in said side wall of said unitary vacuum enclosure for passing the X-rays therethrough so as to maintain vacuum integrity within said unitary vacuum enclosure.

13. The X-ray generating apparatus of claim 12, further comprising an air cooling system which has a plurality of fins disposed outside of said side wall and a fan disposed beneath said fins for passing an air flow therethrough.

14. The X-ray generating apparatus of claim 13, further comprising a cover for said fan and said plurality of fins, whereby heat from said unitary vacuum enclosure transfers directly to said plurality of fins and than to said cover.

15. The X-ray generating apparatus of claim 14, wherein the temperature of said cover does not exceed 200° C.

16. The X-ray generating apparatus of claim 14, wherein said unitary vacuum enclosure, said mounting block, said cathode assembly and said feed through have a thermal capacity with is larger than thermal capacity of said anode target in about one order of magnitude.

17. An X-ray generating apparatus comprising:

a unitary vacuum enclosure;

an anode assembly with a rotating anode target placed within said unitary cylindrical vacuum enclosure;

a cathode assembly spaced from said anode assembly and placed within said unitary vacuum enclosure, said cathode assembly comprising a disk protecting an aperture in a top wall of said unitary vacuum enclosure and being substantially parallel to said anode target, wherein said unitary vacuum enclosure and said disk of said cathode assembly being a shield for the X-rays and scattering electrons generated within said unitary vacuum enclosure.

18. The X-ray generating apparatus of claim 17, wherein said unitary vacuum enclosure and said disk of said cathode assembly are made of a tungsten alloy.

19. An X-ray generating apparatus comprising:

a unitary vacuum enclosure;

an anode and cathode assembly disposed within said unitary vacuum enclosure for generating X-rays which are released through an X-rays window in said unitary vacuum enclosure, said unitary vacuum enclosure being a radiation shield for X-rays and a heat reservoir for heat accumulation during X-rays production;

a mounting block comprising a port with one end terminated by said X-ray window, and another end coupled to said X-ray exit opening so as to maintain a vacuum integrity of said unitary vacuum enclosure, wherein a thermal capacity of said vacuum enclosure and said mounting block is substantially larger than a thermal capacity of said anode assembly; and an air cooling system disposed outside of said unitary vacuum enclosure, said cooling system comprising a plurality of fins and a fan to pass an air flow through said fins.

20. An X-ray generating apparatus comprising:

a unitary vacuum enclosure formed by a cylindrical side wall and having a top and bottom walls with respective openings therein, said top and side walls being made of materials capable to provide a required radiation shielding;

an X-ray window closing the opening in said side wall of said unitary vacuum enclosure;

an anode assembly having a rotating anode target disposed within said unitary vacuum enclosure, said unitary vacuum enclosure having a thermal capacity that is substantially larger than a thermal capacity of said anode target;

a cathode assembly spaced from said anode assembly and having an electron source for emitting electrons that strikes said rotating anode target to generate X-rays which are released through said X-rays window of said unitary vacuum enclosure, a mounting structure for holding said electron source comprising a radiation shield disk protecting an opening in said top wall of said unitary vacuum enclosure, and a mounting block, said mounting block houses said unitary vacuum enclosure and having a body with a plurality of channels therein for cooling said unitary vacuum enclosure by air flow.

* * * * *